US007178696B2

(12) United States Patent
Larsen et al.

(10) Patent No.: US 7,178,696 B2
(45) Date of Patent: Feb. 20, 2007

(54) PORTABLE CLIP-ON SPRAY DISPENSER AND ASSOCIATED METHODS

(76) Inventors: Douglas P. Larsen, 242 E. Heather Rd., Orem, UT (US) 84057; Paul J. Christensen, 1372 W. Center, Orem, UT (US) 84057; Gary L. Pellegrino, 7330 Joseph Dr., Solon, OH (US) 44139

( * ) Notice: Subject to any disclaimer, the term of this patent is extended or adjusted under 35 U.S.C. 154(b) by 85 days.

(21) Appl. No.: 10/997,430

(22) Filed: Nov. 24, 2004

(65) Prior Publication Data

US 2006/0049210 A1 Mar. 9, 2006

Related U.S. Application Data

(60) Provisional application No. 60/525,498, filed on Nov. 26, 2003.

(51) Int. Cl.
*B67D 5/64* (2006.01)

(52) U.S. Cl. ..... 222/175; 222/321.9

(58) Field of Classification Search ..... 222/321.9, 222/175

See application file for complete search history.

(56) References Cited

U.S. PATENT DOCUMENTS 3,830,404 A * 8/1974 Frazer ..... 222/78
5,492,248 A 2/1996 Ortner
5,590,835 A * 1/1997 Rosenthal et al. ..... 239/333
5,927,548 A * 7/1999 Villaveces ..... 222/175
6,273,301 B1 8/2001 Su
6,983,864 B1 * 1/2006 Cagle ..... 222/131

OTHER PUBLICATIONS

PCT International Search Report dated Apr. 14, 2005, 5 pages.

* cited by examiner

*Primary Examiner*—Philippee Derakshani
(74) *Attorney, Agent, or Firm*—TraskBritt

(57) ABSTRACT

A portable spray dispenser includes a spray head, a portable container, and a clip secured to either the spray head or the container. The spray head includes a base, which is configured to be secured to the container, as well as a pump, which may comprise a push button with a nozzle exposed to a peripheral surface thereof. The clip resembles a conventional pen clip and is configured to secure the portable spray dispenser to a thin article, such as a pocket of a physician's coat, a shirt, or a jacket. The clip may be secured to the container, the base of the spray head, or the push button of the spray head, in which case the nozzle may be exposed through a portion of the clip. The portable spray dispenser may be used while remaining secured, by way of the clip, to a thin article.

5 Claims, 7 Drawing Sheets

PORTABLE CLIP-ON SPRAY DISPENSER AND ASSOCIATED METHODS

CROSS-REFERENCE TO RELATED APPLICATION

Under the provisions of 35 U.S.C. § 119(e), this application claims the benefit of U.S. Provisional Application Ser. No. 60/525,498, filed on Nov. 26, 2003.

BACKGROUND OF THE INVENTION

1. Field of the Invention

The present invention relates generally to portable spray dispensers and, more specifically, to pen-type spray dispensers. In particular, a portable spray dispenser according to the present invention includes a clip secured to the spray pump thereof.

2. Background of Related Art

Portable spray dispensers have long been used to provide individuals with ready access to various types of liquid substances, including breath fresheners, perfumes, so-called "defensive" compositions (e.g., pepper spray), and the like. Due to their small size, conventional portable spray dispensers may be stored in a variety of locations, such as purses, pants pockets or coat pockets, glove compartments of automobiles, or desk drawers. Because of their configurations, however, access to stored conventional portable spray dispensers typically requires opening a container (e.g., a purse, a pocket, a glove compartment, a drawer, etc.), some possible searching for the spray dispenser, and removal of the spray dispenser from the container in which it is stored.

A variety of improvements have been developed to make portable spray dispensers more readily accessible when access to the liquid stored therein is desired. For example, some portable spray dispensers have been adapted for carriage on key rings or key chains. As another example, portable spray dispensers that resemble pens have been developed.

U.S. Pat. No. 5,492,248, issued to Ortner, and U.S. Pat. No. 6,273,301, issued to Su, describe examples of pen-type spray dispensers. Each of these apparatus includes a pump-type spray dispenser which is configured to receive a separate cap over the pump and spray nozzle thereof. The cap of each such spray dispenser includes a clip, which is useful for securing the spray dispenser within a shirt or jacket pocket or in another receptacle in such a way that the spray dispenser is partially exposed and more readily accessible when use of the spray dispenser is desired. Somewhat undesirably, however, the cap of this type of pen type-spray dispenser must be removed from over the pump before the contents of the spray dispenser can be expelled.

Accordingly, there are needs for portable spray dispensers which are more easily accessed and more readily used.

SUMMARY OF THE INVENTION

The present invention includes a portable spray dispenser which is configured to be stored for ready access and which may be readily used.

The portable spray dispenser of the present invention includes a spray head, a portable container, and a clip secured to either the spray head or the container. The spray head includes a base, which is configured to be secured to the container, as well as a pump. The pump may have a conventional configuration and comprise a push button that, when depressed, causes fluid within the container to be expelled through a nozzle that is exposed at a peripheral surface of the push button. The clip resembles a conventional pen clip and is configured to secure the portable spray dispenser to a thin article, such as a pocket of a physician's coat, a shirt, or a jacket.

In one embodiment of the portable spray dispenser, the clip may be secured to the push button of the pump of the spray head. When the push button is depressed, the clip also moves. The nozzle may be exposed through the portion of a clip that is secured to the push button. With this configuration, fluid may be expelled through the nozzle as the portable spray dispenser of the present invention remains within a pocket or other receptacle.

The present invention also includes a spray head with a clip secured to a push button of a pump thereof.

In another embodiment, a portable spray dispenser that incorporates teachings of the present invention may include a clip which is secured to the base of the spray head thereof. Still another embodiment of portable spray dispenser according to the present invention includes a clip which is secured to the container thereof.

The clip of a portable spray dispenser according to the present invention facilitates storage thereof in a readily accessible orientation (e.g., with a portion of the portable spray dispenser visible from the exterior of a pocket). In addition, since the clip is located on the spray head or the container of the portable spray dispenser, there is no need to remove a cap in order to access the push button of the spray head. Thus, the placement of the clip on the portable spray dispenser renders the portable spray dispenser ready-to-use when the portable spray dispenser has been accessed.

In this regard, a method of using the portable spray dispenser includes accessing the portable spray dispenser by unclipping a clip thereof from an article on or in which the portable spray dispenser has been stored, orienting the nozzle of the spray head of the portable spray dispenser in a desired direction, and depressing the push button of the spray head to cause the pump to expel fluid that has been stored within the container of the portable spray dispenser from the nozzle. Of course, the clip may then be used to replace or store the portable spray dispenser at a desired location. As an alternative, the portable spray dispenser may remain clipped to an article while in use, so long as it is possible to orient the nozzle in the desired direction.

Other features and advantages of the present invention will become apparent to those of ordinary skill in the art through consideration of the ensuing description, the accompanying drawings, and the appended claims.

BRIEF DESCRIPTION OF THE DRAWINGS

In the drawings, which depict various features of exemplary embodiments of portable spray dispensers that incorporate teachings of the present invention.

DETAILED DESCRIPTION

Figure 1:
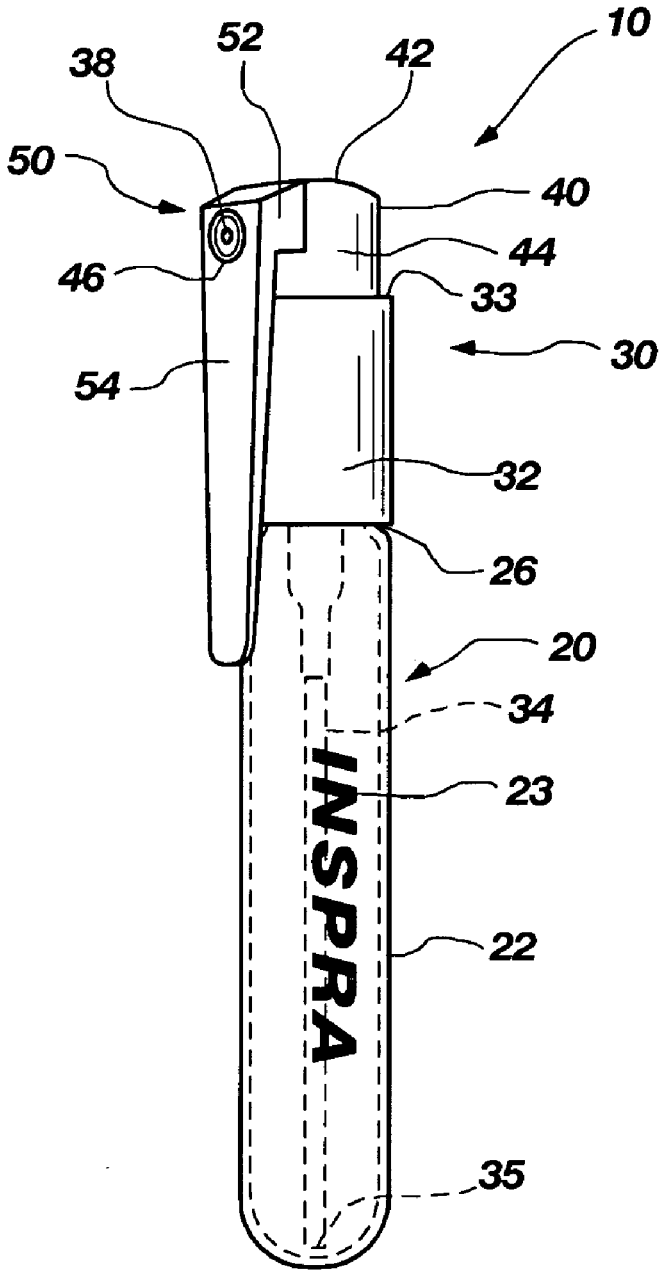
FIG. 1 is a perspective view of an example of a portable spray dispenser according to the present invention, which portable spray dispenser includes a pump with a push button that has a clip secured thereto.
Figure 2:
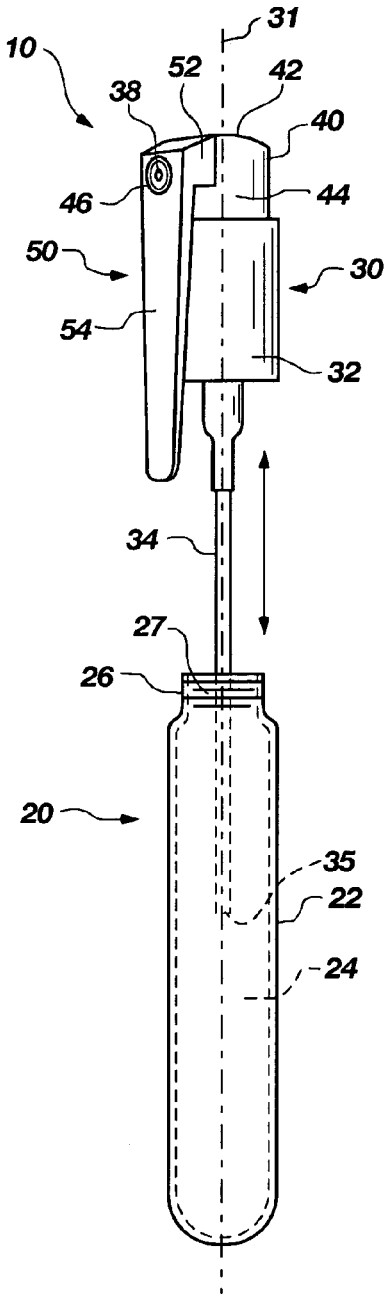
FIG. 2 is a perspective assembly view of the spray dispenser of FIG. 1.
Figure 3:
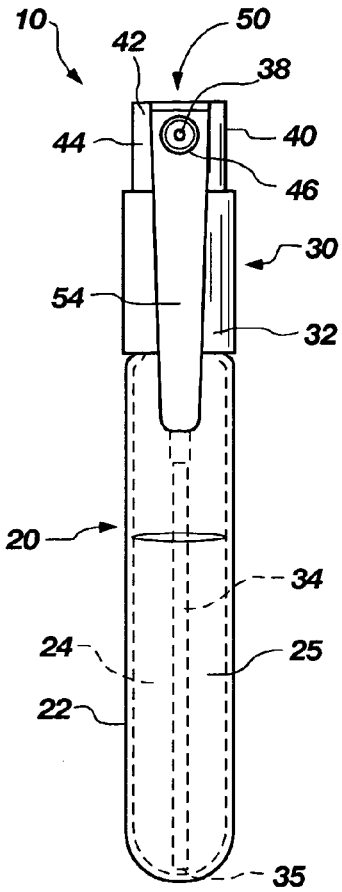
FIG. 3 is a front view of the portable spray dispenser of FIGS. 1 and 2.
Figure 4:
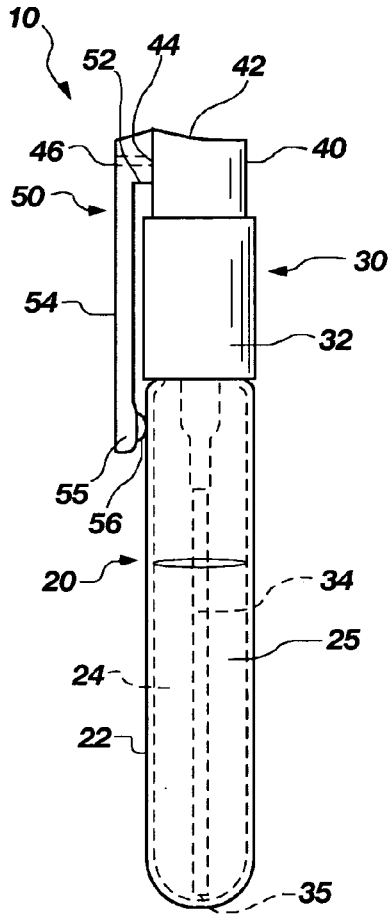
FIG. 4 is a side view of the portable spray dispenser of FIGS. 1 through 3.

With reference to FIGS. 1 through 4, a portable spray dispenser 10 that incorporates teachings of the present invention is illustrated. Portable spray dispenser 10 includes a container 20, a spray head 30, and a clip 50. Spray head 30 is secured to container 20 and is configured to withdraw fluid 25 therefrom and to expel fluid 25. Clip 50 is secured to spray head 30 and, more specifically, to a push button 40 of spray head 30.

Container 20 may include an exterior 22 and an interior 24. Although container 20 is depicted as an elongate element, exterior 22 thereof may have any desired configuration and appearance, the depicted test tube shape merely providing an example. If desired, one or more indicia 23 may be carried by exterior 22. Interior 24 of container 20 is configured to contain a fluid 25. Examples of fluid 25 include, but are not limited to, liquids, such as disinfectants, cleaning solutions (e.g., glass cleaner, soaps, etc.), flavors (e.g., breath fresheners, candy flavors, etc.), perfumes, air fresheners, deodorizers, defensive compositions, and the like, gels, lotions, and other fluids and fluid-like substances.

As container 20 is configured to have spray head 30 secured thereto, an upper end 26 of container 20 may include an outer peripheral surface 27 which is configured, as known in the art (e.g., with a reduced cross-section and threading, to internally receive a portion of base 32 in a pressure-fit configuration, to be secured to base 32 by way of crimping, pressing, or snapping, with a protruding rib thereon, etc.) to receive and securely retain a base 32 of spray head 30.

Spray head 30, which is a pump-type spray head of conventional configuration, includes base 32, a withdrawal tube 34 extending from base 32, a nozzle 38 associated with and in selective flow communication with withdrawal tube 34, and a push button 40 associated with base 32 in such a way as to cause fluid or gas to be drawn into withdrawal tube 34 and ejected from nozzle 38.

Base 32 includes an interior peripheral surface (not shown) configured complementarily to the outer peripheral surface 27 of upper end 26 of container 20 so as to facilitate securing of base 32 to spray head 30. As known in the art, base 32 also contains at least a portion of the internal components of spray head 30, with some of the internal components being configured to draw fluid or gas into spray head 30.

Withdrawal tube 34 protrudes downwardly from an interior of base 32, and is configured to be inserted within interior 24 of container 20 as base 32 of spray head 30 is secured to upper end 26 of container 20. Withdrawal tube 34 is in fluid communication with the internal components (not shown) of spray head 30, which are well known in the art and, thus, for the sake of simplicity, need not be described herein. The internal components of spray head 30, in turn, communicate with nozzle 38, which is configured to expel fluid or gas (e.g., air) that has been drawn into spray head 30 by withdrawal tube 34.

As shown, nozzle 38 is configured to spray a liquid. Of course, when fluid 25 within container 20 comprises a thicker fluid, such as a gel or lotion, nozzle 38 may be configured to dispense the thicker fluid 25 without spraying the same. Further, such a nozzle 38 may include a tubular protrusion for directing the thicker fluid 25 dispensed therethrough.

Spray head 30 also includes a push button 40. Push button 40 includes a depression surface 42, which may be contoured to facilitate comfortable depression of push button 40 with an individual's finger, and an outer periphery 44. Clip 50 may comprise a separately formed element that is secured to outer periphery 44 or be secured to outer periphery 44 by virtue of being formed integrally with push button 40.

Clip 50 includes a spacing element 52 which extends in a generally lateral direction (i.e., transverse to axis 31 of spray head 30) from outer periphery 44, while an elongate retention element 54 extends from spacing element 52 in substantially the same direction as withdrawal tube 34 and may be oriented substantially parallel to longitudinal axis 31 of spray head 30. Additionally, clip 50 may include a protruding element 56 that extends from an end 55 of elongate retention element 54 located opposite spacing element 52 generally toward longitudinal axis 31. Protruding element 56 may space elongate retention element 54 a suitable distance apart from base 32 or container 20 that a thin member (e.g., a pocket, sleeve, cover of a notebook, sheet of paper, etc.) may be disposed therebetween, as well as facilitate the retention of such a thin member between elongate retention element 54 and base 32 or container 20.

Push button 40 may also include a nozzle retaining aperture 46 formed through outer periphery 44 and, optionally, through spacing element 52 of clip 50. Nozzle 38 is, of course, retained within and oriented by nozzle retaining aperture 46, which also facilitates exposure of nozzle 38 to exterior 22 of portable spray dispenser 10.

As known in the art, when in an "open" position, push button 40 is configured to move back and forth (e.g., up and down) substantially along an axis 31 of spray head 30. As push button 40 is depressed toward base 32, fluid or gas is forced into an exposed end 35 of withdrawal tube 34, along the length of withdrawal tube 34, through the internal components (not shown) of spray head 30, and through nozzle 38, from which the fluid or gases are expelled. In addition, more fluid or gas is drawn into withdrawal tube 34. When released, at least one internal component of spray head 30 (e.g., a spring thereof) biases push button 40 away from base 32, as known in the art, causing push button 40 to return to a nondepressed position, as shown in FIGS. 1 through 4.

Push button 40 and base 32 may be configured to facilitate positioning of push button 40 between "locked" and "open" positions. In the "locked" position, movement of push button 40 relative to base 32 is prevented; thus, push button 40 may not be used to draw fluid or gas into withdrawal tube 34 or to expel the same through nozzle 38. Conversely, in the "open" position, push button 40 may be moved relative to base 32 and, thus, fluid or gas may be drawn into withdrawal tube 34 and expelled through nozzle 38.

While any suitable, known locking mechanism may be employed, FIGS. 5A through 5F depict an exemplary locking mechanism 90. As shown in FIGS. 5A through 5F and, particular, in FIG. 5B, push button 40 of spray head 30 is rotatable, about a central axis 41 thereof, relative to base 32.

Push button 40 includes protruding legs 91 (two diametrically opposed legs 91 (individually, legs 91*a* and 91*b*) are shown in the illustrated, exemplary embodiment). Legs 91 protrude from push button 40 so as to extend toward or into base 32 when push button 40 and base 32 of spray head 30 are assembled with one another. Each leg 91 may have a width W1 (e.g., about 8.625 mm, about 9.625 mm, etc.). Legs 91 may be spaced a distance D1 (e.g., about 12.625 mm) apart from one another.

With continued reference to FIGS. 5C through 5F, posts 95 (individually shown as posts 95*a* through 95*e* in the illustrated, exemplary embodiment) may protrude from base 32 of spray head 30. Posts 95 extend toward push button 40 when push button 40 and base 32 of spray head 30 are assembled with each other. Posts 95 are arranged to either permit spray (e.g., longitudinal) movement of push button 40 relative to base 32 or to prevent such movement. In this regard, posts 95 and legs 91 are correspondingly arranged to facilitate positioning of push button 40 in both the "locked" and "unlocked" positions.

Posts 95*a* and 95*b* and posts 95*c* and 95*d* are positioned apart from one another a distance W2, which is greater than width W1 (e.g., about 10.625 mm). Thus, a leg 91 may be inserted between post 95*a* and 95*b*, as well as between post 95*c* and 95*d*.

Posts 95*b* and 95*c* and posts 95*d* and 95*e*, which comprise pairs 96 of posts 95, are spaced apart from one another a distance D2, which is less than width W1. Thus, legs 91 may not be inserted between the posts 95 of a pair 96.

The width W3 of each pair 96 is less than distance D1 between adjacent legs 91 of push button 40. Thus, a pair 96 of posts 95 may be inserted between adjacent legs 91.

Post 95*a* protrudes a sufficient distance to provide a stop for legs 91 of push button 40 and, thus, to stop rotational movement of push button 40 relative to base 32 of spray head 30, even when push button 40 is not depressed. When rotational movement of push button 40 is prevented in this manner, legs 91 and posts 95 may be aligned in either the "open" position or the "locked" position.

Figure 5A:
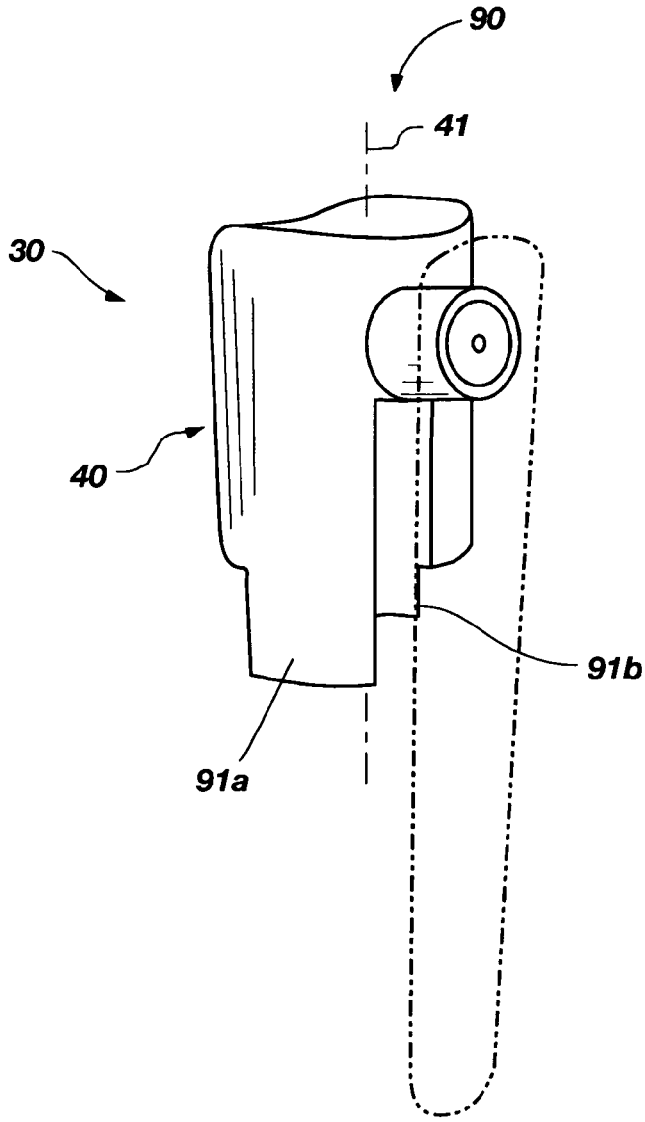
FIG. 5A is a perspective view of an exemplary embodiment of spray head that includes a locking mechanism.
Figure 5B:
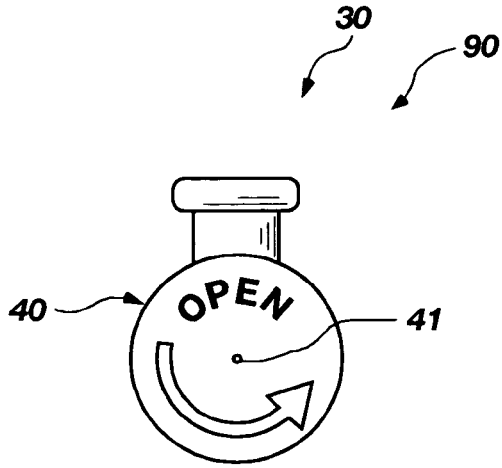
FIG. 5B is a top view of the spray head shown in FIG. 5A.
Figure 5C:
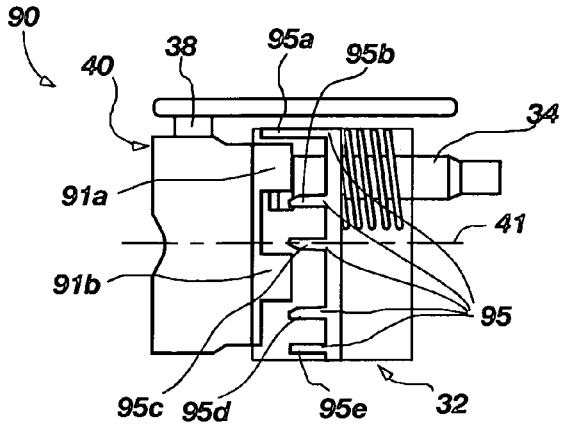
FIGS. 5C and 5D are assembly views showing the spray head of FIGS. 5A and 5B in "open" and "locked" positions, respectively.
Figure 5D:
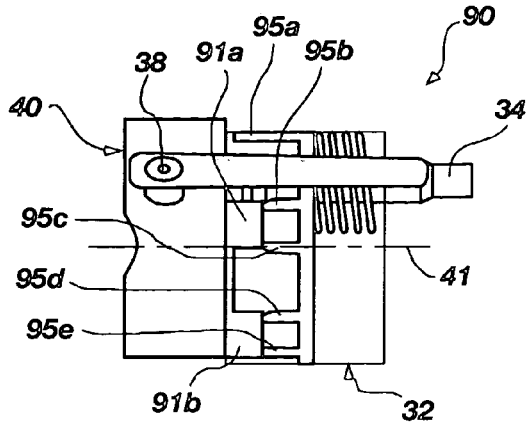
Figure 5E:
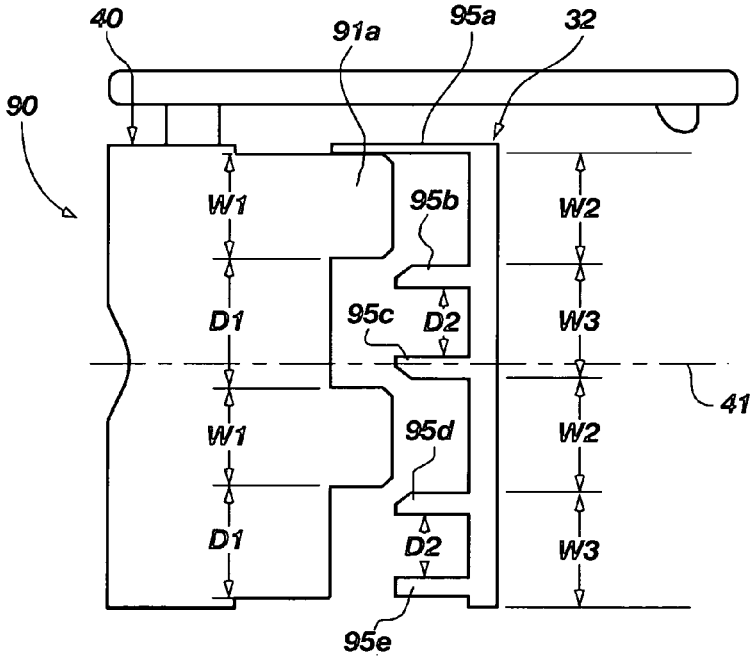
FIG. 5E is a schematic representation showing the relative dimensions of legs protruding from the push button and posts protruding from the base of the spray head depicted in FIGS. 5A through 5D, with the push button and the base depicted as unwrapped and flattened.
Figure 5F:
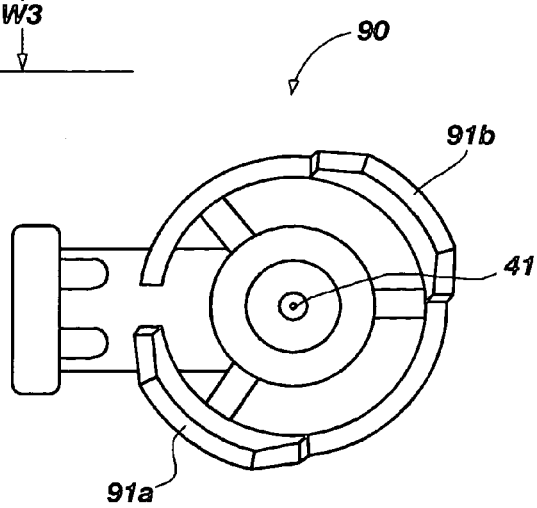
FIG. 5F is a bottom view of the push button of the spray head shown in FIGS. 5A through 5E.

As shown in FIGS. 5C and 5E, when push button 40 is rotated such that leg 91*a* abuts post 95*a*, legs 91 are aligned between pairs 96 of posts 95 and pairs 96 of posts 95 are aligned between legs 91, thereby facilitating depression of push button 40 relative to base 32 and, in turn, the drawing of fluid or gas into withdrawal tube 34 and expulsion of the same through nozzle 38. Thus, when leg 91*a* abuts post 95*a*, push button 40 is in the "open" position.

When push button 40 is rotated relative to base 32 so that leg 91*b* abuts post 95*a*, as illustrated in FIG. 5D, legs 91 one or more of posts 95*b* through 95*e* prevent push button 40 from being depressed. Push button 40 is, therefore, in a "locked" position.

The corners of one or more legs 91 or posts 95 may be rounded or tapered to facilitate depression of push button 40 when legs 91 are only in rough alignment between pairs 96 of posts 95 (i.e., push button 40 is not completely in the "open" position).

Figure 8:
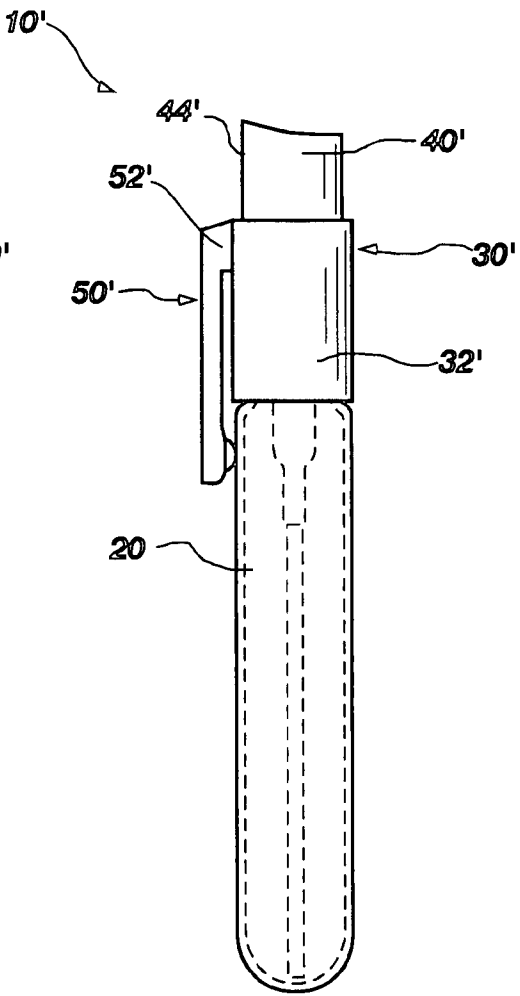
FIG. 8 is a side view of the portable spray dispenser of FIGS. 6 and 7.
Figure 7:
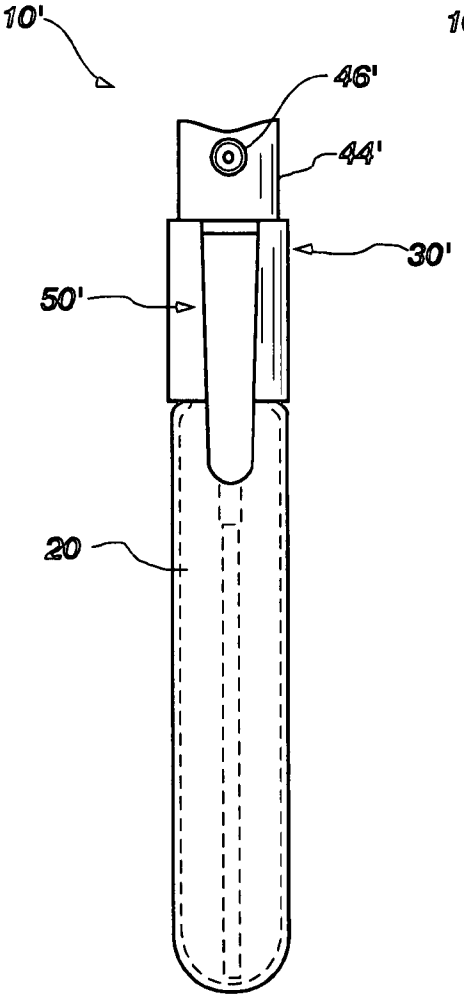
FIG. 7 is a front view of the portable spray dispenser of FIG. 6.
Figure 6:
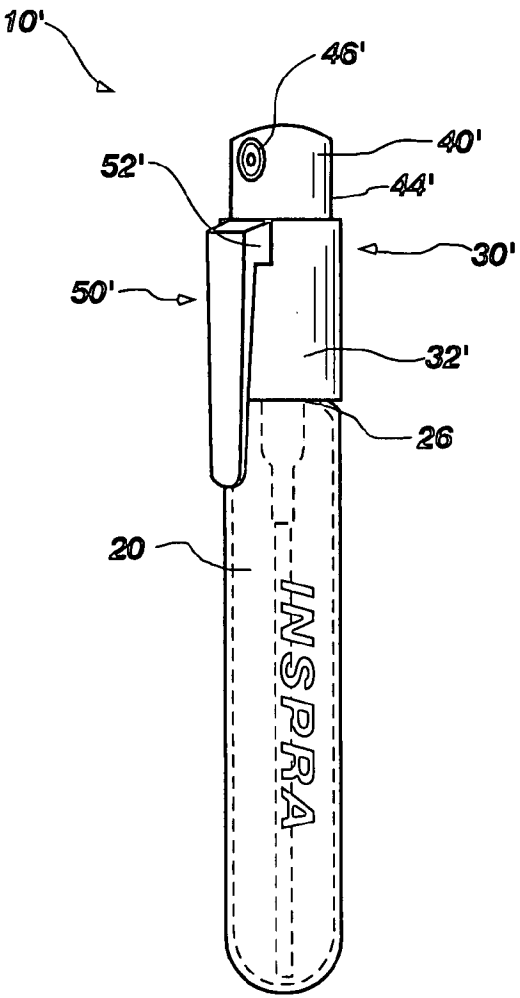
FIG. 6 is a perspective view of another exemplary embodiment of portable spray dispenser incorporating teachings of the present invention and including a clip secured to a base of a spray head thereof.

Another embodiment of portable spray dispenser 10' according to the present invention is shown in FIGS. 6 through 8. Like portable spray dispenser 10 (FIGS. 1 through 4), portable spray dispenser 10' includes a container 20, a spray head 30' securable to an upper end 26 of container 20, and a clip 50'. Container 20 may include the same features that have been described in reference to FIGS. 1 through 4. Spray head 30' and clip 50' may likewise include the same features as those of spray head 30 and clip 50, which have been described in reference to FIGS. 1 through 4, the only differences being that spacing element 52' of clip 50' is secured to a base 32' of spray head 30' rather than to a push button 40' thereof, nozzle retaining aperture 46' extends only through outer periphery 44' of push button 40', and clip 50' lacks a nozzle retaining aperture 46'.

Figure 11:
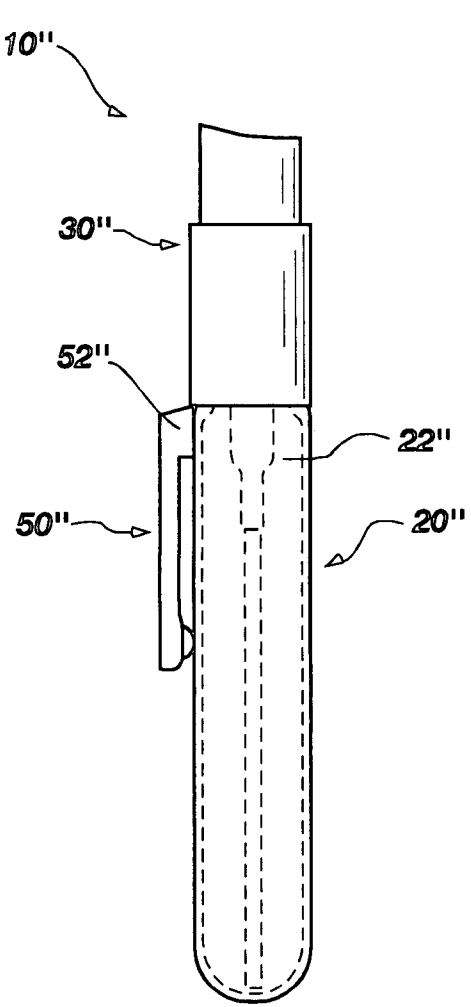
FIG. 11 is a side view of the portable spray dispenser of FIGS. 9 and 10.
Figure 10:
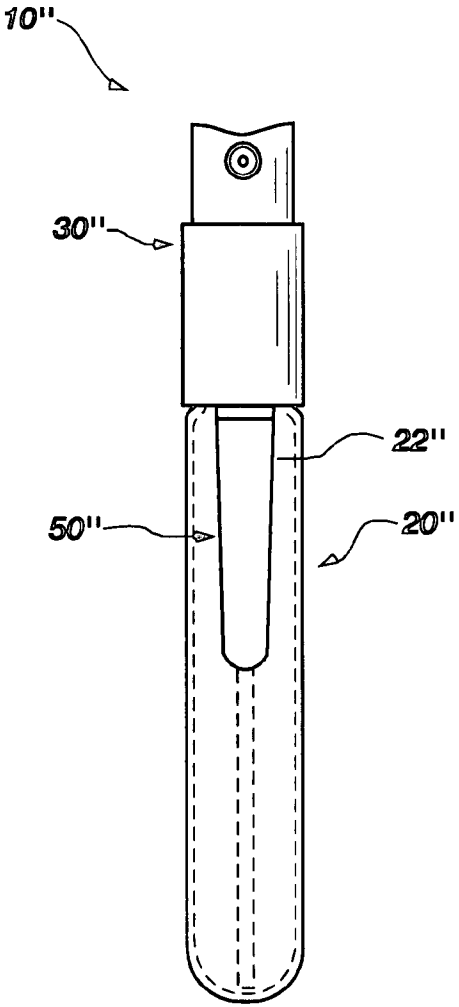
FIG. 10 is a front view of the portable spray dispenser of FIG. 9.
Figure 9:
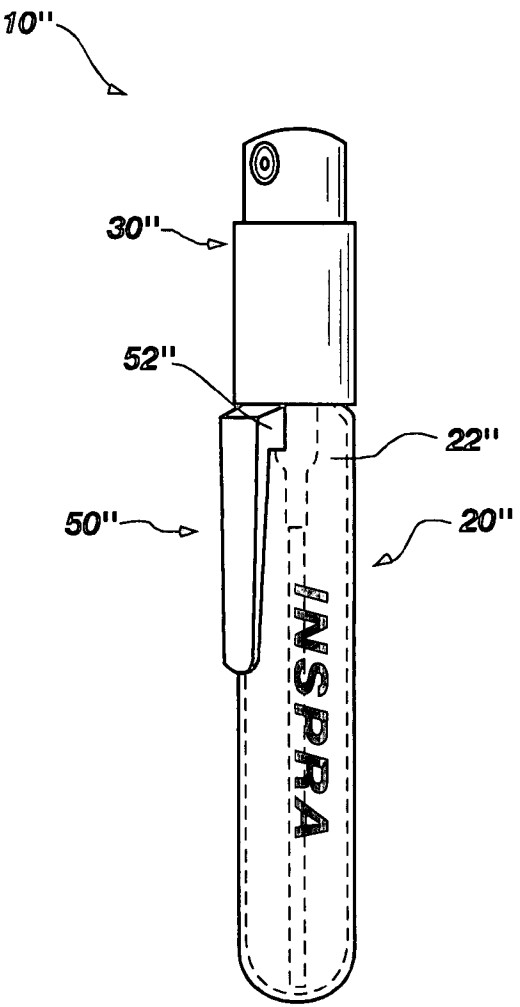
FIG. 9 is a perspective view of a portable spray dispenser of the present invention that includes a clip secured to a container thereof.

FIGS. 9 through 11 depict another embodiment of portable spray dispenser 10", which includes a container 20", a spray head 30", and a clip 50". The primary difference between container 20" and container 20, which is described above in reference to FIGS. 1 through 4, is that spacing element 52" of clip 50" extends from exterior 22" of container 20", whereas clip 50 of portable spray dispenser 10 is not secured to container 20 thereof. In addition, spray head 30" differs from spray heads 30 (FIGS. 1 through 4) and 30' (FIGS. 6 through 8) in that there is no clip secured to any portion of spray head 30".

Figure 12:
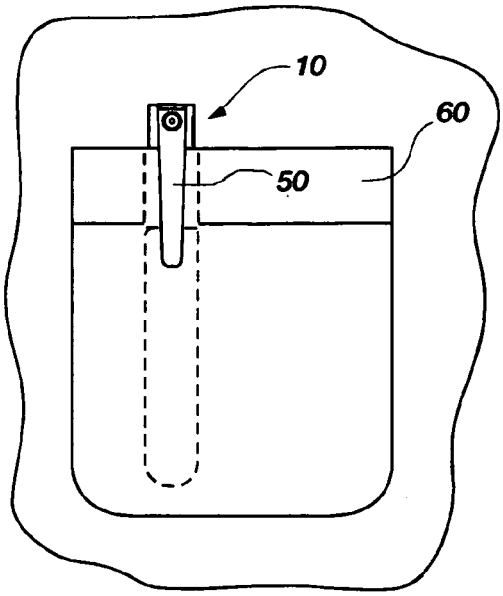
FIG. 12 illustrates an example of storage of the portable spray dispenser of FIGS. 1 through 4.
Figure 13:
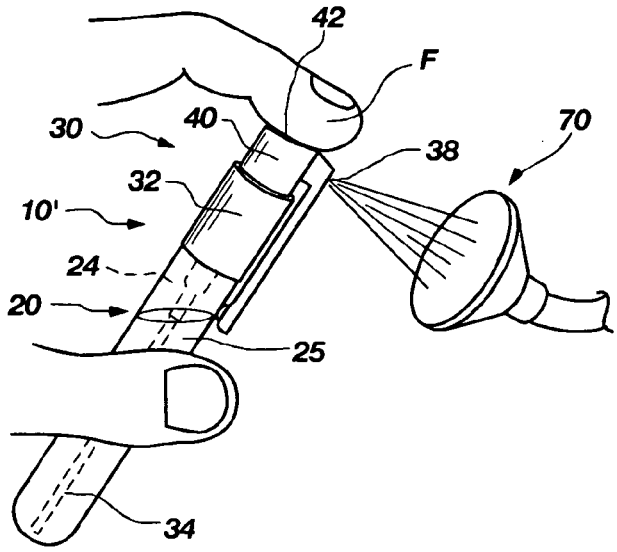
FIG. 13 illustrates an example of use of the portable spray dispenser of FIGS. 1 through 4, in which the portable spray dispenser has been removed from a storage location.

Turning now to FIGS. 12 and 13, an example of the use of portable spray dispenser 10, which is also applicable to portable spray dispensers 10' (FIGS. 6 through 8) and 10" (FIGS. 9 through 11) is illustrated. As shown in FIG. 12, an individual may access portable spray dispenser 10', such as by unclipping clip 50 thereof from a pocket 60 or other storage location, and grasp the same. When grasping portable spray dispenser 10, as shown in FIG. 13, the individual may position his or her finger F over depression surface 42 of push button 40 and orient nozzle 38 toward a desired location, such as toward the depicted stethoscope 70 or another medical device, or any other device, location, or surface. By placing a load on depression surface 42 with his or her finger F, the individual may then depress push button 40 of spray head 30 (i.e., force push button 40 toward base 32 of spray head 30), causing a fluid 25, such as a disinfectant, another liquid, a gel, or lotion, contained within interior 24 of container 20 to be drawn through withdrawal tube 34 and spray head 30 and to be expelled through nozzle 38, toward the desired location, such as onto the depicted stethoscope 70. Thus, portable spray dispenser 10 provides an individual with ready access to and use of fluid 25 held within container 20 thereof.

Figure 14:
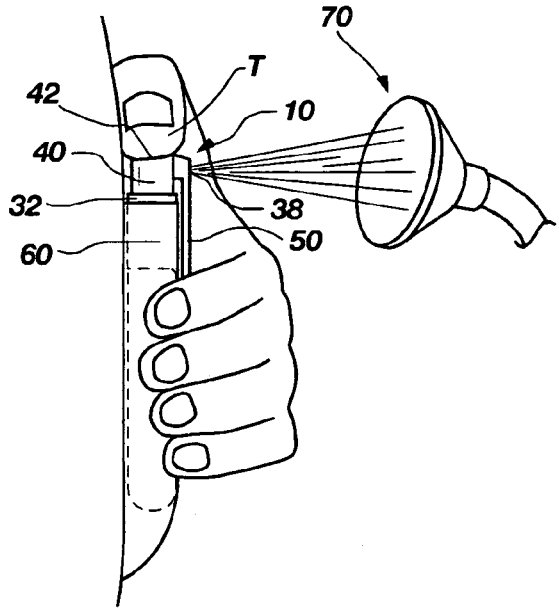
FIG. 14 illustrates another example of use of the portable spray dispenser of FIGS. 1 through 4, in which the portable spray dispenser is used while remaining in its storage location.

Alternatively, portable spray dispenser 10 may be accessed and used while remaining at a stored location, as shown in FIG. 14. An individual may access push button 40 of portable spray dispenser 10 while container 20 thereof remains within a pocket 60 and while clip 50 remains secured to pocket 60, with nozzle 38 oriented away from pocket 60 and toward a desired location, such as the illustrated stethoscope 70 or another medical device. In accessing push button 40, the individual may place his or her thumb T or a finger F against depression surface 42 thereof and apply a load to depression surface 42, forcing push button 40 toward base 32 and causing fluid 25, such as a disinfectant, another liquid, a gel, or lotion, to be expelled from nozzle 38 and toward the desired location, such as onto stethoscope 70 or another medical device, or any other device, location, or surface.

Figure 15:
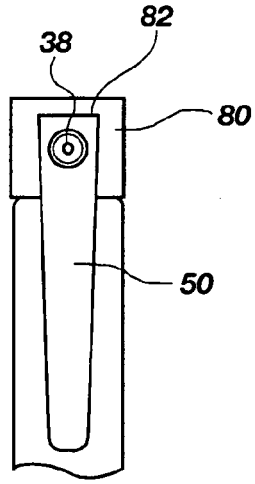
FIG. 15 is a partial front view of a portable spray dispenser including a temporary cap over the push button of the spray head thereof to prevent depression of the spray head during shipping or other transportation of the portable spray dispenser.

As shown in FIG. 15, a protective cap 80 may receive and be disposed over push button 40 (FIGS. 1 through 4) of spray head 30, resting on an upper surface 33 of base 32 of spray head 30. Protective cap 80 may include a slot 82, which is configured to receive clip 50, if a clip 50 protrudes from push button 40. Protective cap 80 may be secured to push button 40 by an interference or pressure fit, and easily removed therefrom to provide access to push button 40. As an example of the use of protective cap 80, it may installed over push button 40 of portable spray dispenser 10, container 20 of which may already be filled with fluid 25, prior to shipping or transportation thereof. Thus, during shipping or portable transportation, protective cap 80 prevents movement of push button 40 and, thus, prevents fluid 25 from being expelled from spray dispenser 10 and, thus, from creating a mess during shipping or transportation.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed:

1. A portable spray dispenser, comprising:

a container including an interior for holding a fluid;

a spray head including a base secured to an end of the container and a push button configured to move relative to the base to withdraw at least a portion of the fluid therefrom and to effect expulsion of at least the portion of the fluid through a nozzle of the spray head; and a clip secured to the push button of the spray head, the nozzle being exposed through a portion of the clip.

2. The portable spray dispenser of claim 1, wherein the nozzle is at least partially held within an aperture extending through the portion of the clip.

3. The portable spray dispenser of claim 1, wherein the container has a test tube-like appearance.

4. A spray head for a portable spray dispenser, comprising:

a base configured to be secured to a container so as to draw fluid therefrom;

a push button secured to the base and movable relative thereto to effect withdrawal of fluid from the container upon securing of the base thereto and expulsion of the fluid through a nozzle; and a clip secured to the push button, the nozzle being exposed through a portion of the clip.

5. The spray head of claim 4, wherein the nozzle is at least partially held within an aperture extending through the portion of the clip.

* * * * *